United States Patent [19]

Keeler et al.

[11] 4,041,767

[45] Aug. 16, 1977

[54] TESTING APPARATUS FOR USE IN CALIBRATING WRISTWATCHES

[76] Inventors: Eugene R. Keeler, 11093 Petal Ave., Fountain Valley, Calif. 92708; Michael R. Harrison, 7691 - 13th St., Westminster, Calif. 92683

[21] Appl. No.: 733,381

[22] Filed: Oct. 18, 1976

[51] Int. Cl.[2] ..... G04D 7/12

[52] U.S. Cl. ..... 73/6; 324/82

[58] Field of Search ..... 73/6; 324/78 R, 82, 324/79

[56] References Cited

U.S. PATENT DOCUMENTS

| | | | |
|---|---|---|---|
| 2,896,161 | 7/1959 | Fox | 324/79 |
| 3,255,625 | 6/1966 | Ellison | 73/6 |
| 3,305,776 | 2/1967 | Duncan, Jr. et al. | 324/82 |

*Primary Examiner*—S. Clement Swisher
*Attorney, Agent, or Firm*—Christie, Parker & Hale

[57] ABSTRACT

Timing apparatus is provided for use in calibrating a wristwatch whose timing accuracy depends on the oscillation frequency of an electrical oscillator in the wristwatch. Electrical energy radiated from the wristwatch is picked up and in response there is produced a first periodic signal whose fundamental frequency depends on the oscillation frequency. In response to the first periodic signal there is produced a second periodic signal. The first and second periodic signals have the same fundamental frequency, but a frequency-dependent phase-shifting circuit causes a phase shift to be defined between the first and second periodic signals. The amount of this phase shift depends on the frequency difference between the equal fundamental frequencies and a predetermined standard frequency. An indicator is provided, and a phase-difference detecting circuit arrangement causes the indicator to display an indication of said frequency difference.

6 Claims, 7 Drawing Figures

Fig. 4B (FOR LOW FREQ. CASE)

Fig. 4C (FOR HIGH FREQ. CASE)

Fig. 4D (FOR CORRECT FREQ. CASE)

TESTING APPARATUS FOR USE IN CALIBRATING WRISTWATCHES

BACKGROUND OF THE INVENTION

This invention relates to a testing apparatus useful in calibrating a wristwatch, such as a digital watch, which includes a crystal-controlled oscillator serving as its timing standard.

One of the factors that has led to the great demand for quartz watches is their ability to operate with high accuracy. It is now reasonable for a consumer to expect his quartz watch to neither gain nor lose more than about one-half second per day. Otherwise expressed, their accuracy is about 6 parts per million (ppm) or better.

The timing accuracy of the watch is directly dependent on the frequency of a crystal-controlled oscillator in the watch. The output of the watch oscillator serves as a clocking signal for an integrated circuit multi-stage binary counter that serves as a frequency divider. In a digital watch, display elements such as LED's are illuminated in accordance with the count defined by the counter. It has become fairly standard practice in the industry for the watch oscillator to be designed for operation at 32,768 Hz. (At least one manufacturer provides an oscillator that is designed to operate 24 times higher, i.e., 786,432 Hz.)

It is also a fairly standard practice in the industry to provide an adjustable component such as a trimming capacitor as part of the watch oscillator. By adjusting the trimming capacitor, the oscillator operating frequency can be adjusted so that it is extremely close to the desired or design center frequency. A practical limit is set on this in that temperature variations, aging, and like factors affect the stability of the operating frequency. Because of these factors, it is more than acceptable if this watch oscillator is adjusted against a calibration standard whose own accuracy is approximately 0.5 ppm.

In order to know how much and in which direction such adjustment should be made, it is necessary to ascertain how close the operating frequency of the oscillator is to the desired frequency, whether it be the 32,768 Hz design center or the 786,432 Hz design center. This problem is a particulrly acute one for a small business where digital watches are sold and repaired. The jeweler is interested in being able to adjust the trimming component within the watch so that the timing standard meets desired specifications as to design center frequency. This could be done in many different ways, particularly if the jeweler had a large budget for purchasing expensive electronic measuring equipment. It is another matter, of course, to provide a relatively inexpensive, easy to operate, adequately accurate instrument to facilitate the adjustment.

A variety of approaches have been proposed with respect to this problem. One aspect of the problem which has acceptably been overcome in prior art approaches relates to sensing the frequency of the watch oscillator without loading it. In U.S. Pat. No. 3,892,124, for example, there is described an analyzer which employs a technique whereby electromagnetic radiation from the watch oscillator is picked up by an antenna and then amplified. In this prior art analyzer, the amplified signal and a reference signal are supplied to a mixer. The reference signal is generated by a crystal-controlled reference oscillator in the analyzer. A difference or beat frequency is produced by the mixer to provide a measure of the difference in frequency between the frequency of the watch oscillator and the frequency of the reference oscillator. The foregoing arrangement suffers from the disadvantage that it is relatively complex, and is accordingly costly to manufacture.

Other prior art instruments have other shortcomings. In some calibration instruments, a digital counter is used to effect a frequency measurement by counting during predetermined measurement intervals. The measurement intervals are defined repetitiously whereby the overall measurement process can be considered to be a sampling process. The problem here is that the calibration instrument has a slow response time. This makes it difficult for the jeweler to adjust the watch oscillator frequency to the desired value. In particular, there is a tendency to overshoot, in one direction or another, the desired frequency during the time that the sampling period is being defined.

SUMMARY OF THE INVENTION

This invention is directed to apparatus for testing the timing accuracy of a wristwatch. Advantages of the apparatus of this invention reside in its simplicity low cost, rapid response, and accuracy. The wristwatches that can be tested by the testing apparatus are those whose timing accuracy depends on the oscillation frequency of an electrical oscillator in the wristwatch.

The apparatus comprises means for deriving electrical energy radiated from the wristwatch to produce a first periodic signal, the fundamental frequency of which depends on said oscillation frequency. In the preferred embodiment, an antenna is provided to pick up the electrical energy radiated by the wristwatch. An amplifier circuit means that produces the first periodic signal in the form of a square wave having the same fundamental frequency as the watch oscillator.

The apparatus further includes circuit means responsive to the first periodic signal for producing a second periodic signal, the fundamental frequency of which equals the fundamental frequency of the first periodic signal. The circuit means includes frequency-dependent phase-shifting means for causing a phase shift to be defined between the first and second periodic signals, with the amount of the phase shift being dependent on the frequency difference between the equal fundamental frequencies and a predetermined standard frequency. In the preferred embodiment, the second periodic signal has the same waveshape as the first periodic signal (i.e., a square wave), and is delayed relative thereto by approximately one quarter of a cycle; i.e., approximately a 90-° phase difference. The closer the fundamental frequency is to the predetermined frequency, the closer the phase difference is to 90°.

Preferably, the frequency-dependent phase-shifting means comprises a quartz crystal that is connected in a feedback path of a negative feedback amplifier circuit. The quartz crystal has a frequency-dependent characteristic that causes the extent of the phase shift between the output of the amplifier circuit and the input thereto to depend on said frequency difference.

The apparatus further includes an indicator and phase-difference detecting means responsive to the first and second periodic signals for producing an indicator control signal to cause the indicator to display an indication of said frequency difference. Preferably, the phase-difference detecting means includes gating circuit means for producing time spaced apart pulses that each have a pulse width that depends on said phase shift. A smoothing circuit responds to the pulse-width-controlled pulses to produce the indicator control signal.

Other preferred features of the apparatus of this invention are described in detail below and are brought out in the appended claims.

DETAILED DESCRIPTION

Figure 1:
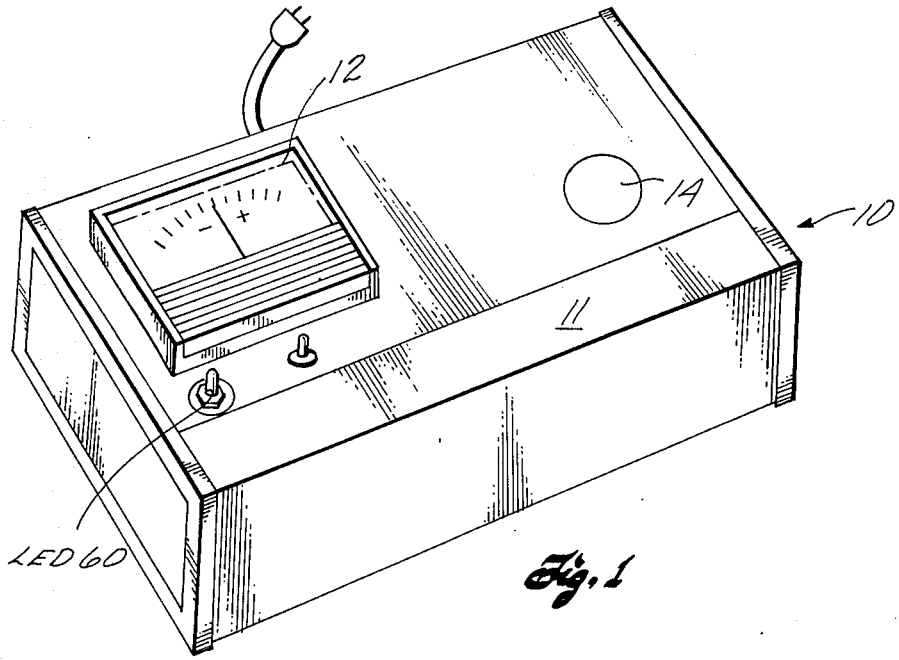
FIG. 1 is a perspective view of a suitable case for containing the electronic components used in the preferred embodiment of this invention.

As shown in FIG. 1, there is provided a case 10 having a top panel 11. An indicator 12 is visible through an opening in top panel 11 to provide for displaying measurement results obtained in using the testing apparatus of this invention.

In use of the testing apparatus, a quartz wristwatch (not shown) is placed atop a sensor area 14 of top panel 11. Electrical energy is radiated from the wristwatch owing to the operation of the crystal controlled oscillator in the wristwatch. In most models, the design center frequency of the oscillator in the wristwatch is 32,768 Hz. The closer the actual frequency of the oscillator in a given unit is to the design center frequency, the more accurately the wristwatch will keep time. The back plate of the wristwatch can be opened to provide access to a trimming or tuning capacitor that forms part of the watch oscillator.

As will be explained in greater detail, indicator 12 will shown a null (i.e., its pointer will be centered) during a test if the actual frequency of the watch oscillator equals a predetermined calibration frequency. The calibration frequency can be made substantially equal to the design center frequency, an accuracy of 0.5 ppm being feasible. If the actual frequency is higher, the pointer is deflected to an angular position on one side of the center; and if the actual frequency is lower, the pointer is deflected to an angular position on the opposite side of the center. A jeweler can, accordingly, adjust the trimmer until the indicator displays a null and thereby calibrate the watch oscillator.

Figure 2:
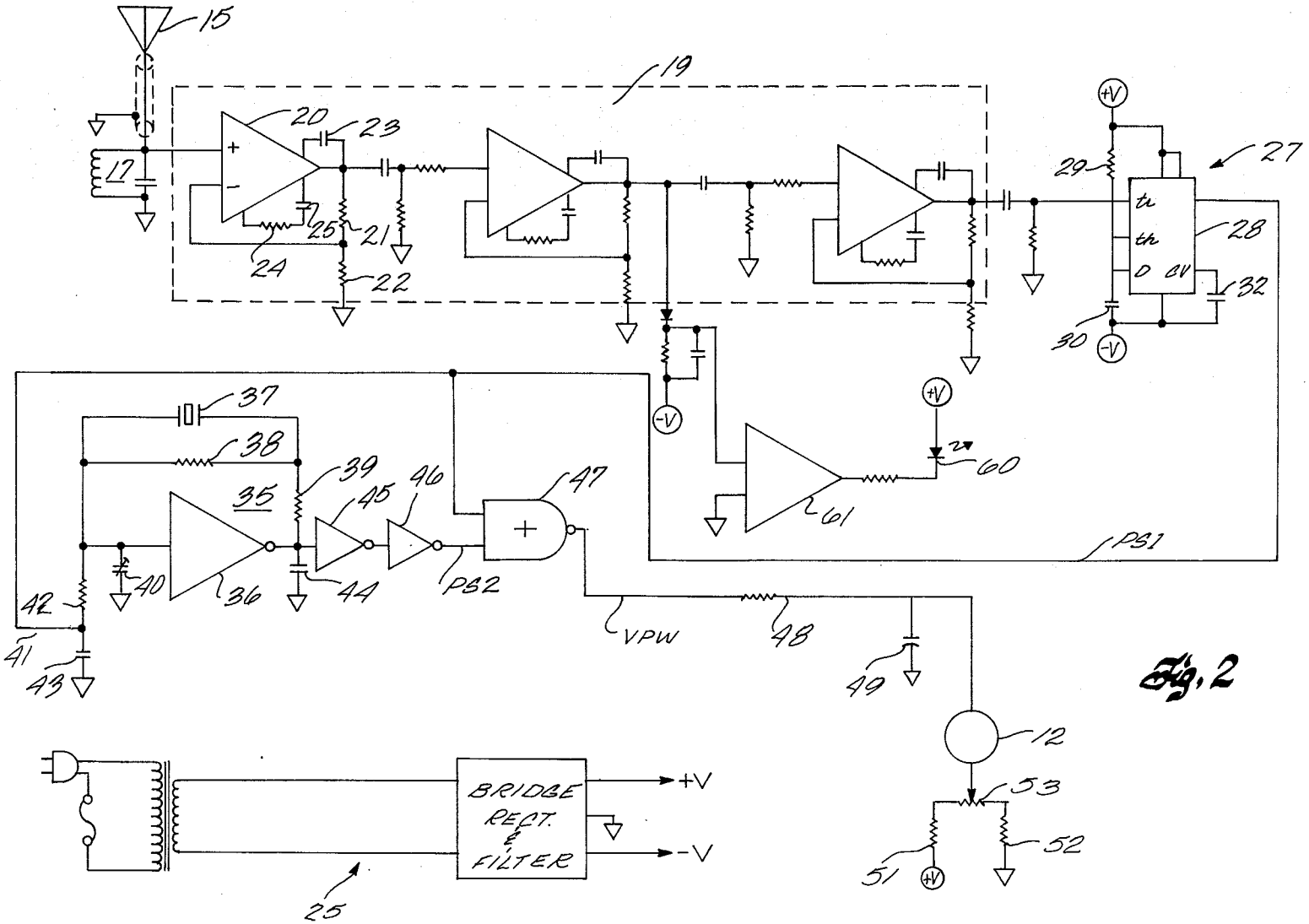
FIG. 2 is a block and schematic diagram showing the preferred arrangement of the circuitry employed in this invention.

Consider now FIG. 2. An antenna 15 receives electrical energy radiated from the wristwatch when the wristwatch is placed on sensor area 14 (FIG. 1). A tuned circuit 17 is connected between antenna 15 and a multi-stage amplifier generally indicated at 19. The magnitude of the input voltage across circuit 17 is in the order of a few microvolts. The overall gain or amplifier 19 is in the order of one million.

In the preferred embodiment, each stage of multistage amplifier 19 has the same configuration, and therefore only one of them bears detailed description. An integrated circuit (IC) operational amplifier 20, preferably a $\mu$ A709, has an inverting input (−)and a noninverting input (+). A feedback resistor 21 is connected between the output of operational amplifier 20 and the inverting input thereof. A resistor 22 is connected between the inverting input and ground. The ratio of the resistance values of resistors 21 and 22 determines the gain of the stage. In order to ensure the stability of the stage, there are provided standard frequency compensation components in accordance with recommendations of the manufacturer of the IC operational amplifier. These components include a capacitor 23, a resistor 24, and a capacitor 25.

For simplicity, the drawing omits the power input terminals for the operational amplifiers and other integrated circuits described below. A power supply generally indicated at 25 is contained within case 10 to provide DC operating power (+V and −V) for these circuits.

The output of the last stage of multi-stage amplifier 19 is connected to the input of a shaping circuit 27. A first periodic signal PS1 in the form of a square wave is produced by shaping circuit 27. Preferably, shaping circuit 27 includes an integrated circuit timer 28 that is sold by National Semiconductor Corporation and various other semiconductor manufacturers under the designation 555. Timer 28 has a trigger terminal (tr), a threshold input terminal (th), and a control voltage input terminal (CV). It has an output terminal Q for producing a binary-valued signal, and it has an output terminal (D) which is connected to a transistor discharge switch within the timer.

The operating characteristics of timer 28 are such that it has a set state and a reset state. It is triggered into its set state when the voltage applied to its trigger input falls below a trigger level. It returns to its reset state when the voltage applied to its threshold input rises above a threshold level.

As employed in shaping circuit 27, the discharge and threshold terminals are connected together. A resistor 29 and a capacitor 30 define an RC timing network for controlling the length of time that timer 28 stays in its set state after having been triggered. A capacitor 32 is connected to the CV terminal to ensure that noise does not influence circuit operation.

Figure 4A:
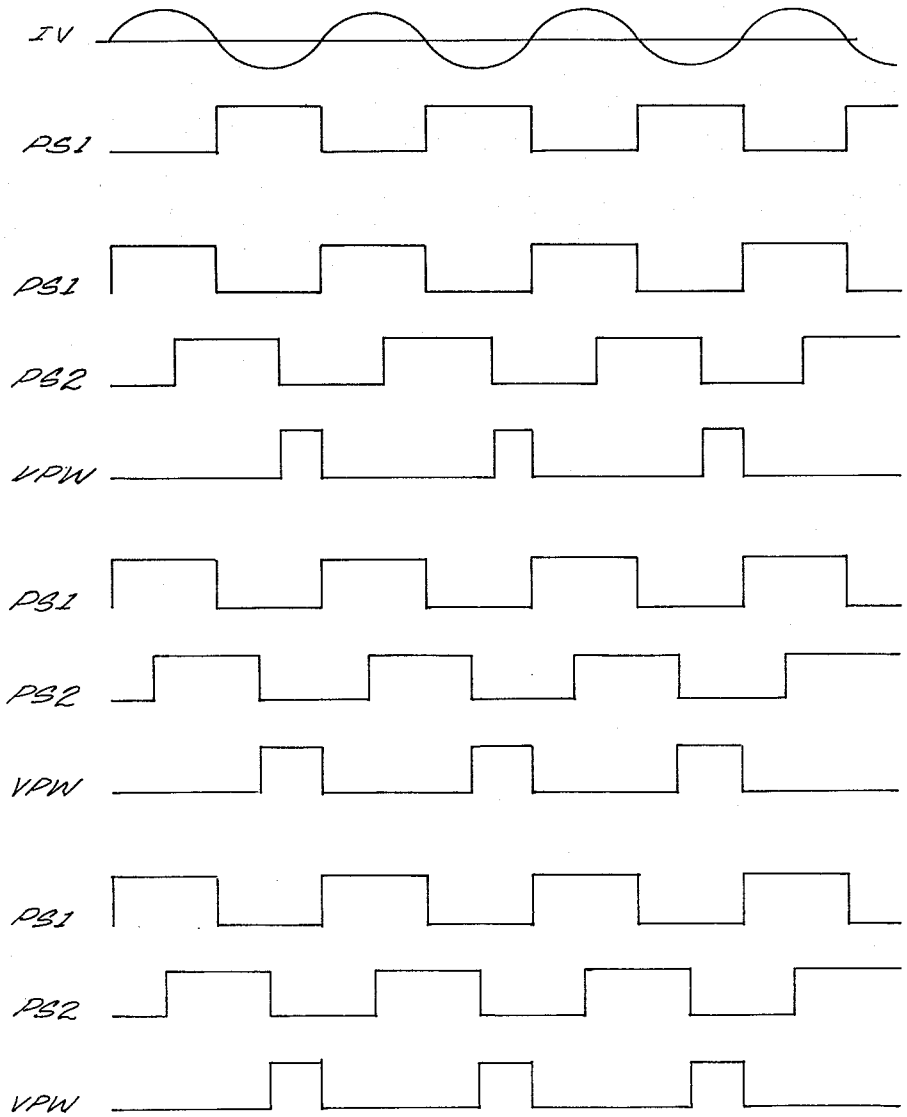
FIG. 4 comprises FIG. 4A, 4B, 4C, and 4D which are timing diagrams showing the waveforms of signals produced by various circuits employed in a preferred embodiment.

Consider now FIG. 4 briefly. The sinusoidal waveform IV is exemplary of the input voltage which develops across tuning circuit 17 in response to the deriving of electrical energy from the wristwatch by antenna 15. Waveform PS1 shows the first periodic signal which shaping circuit 27 produces in response to the amplified input voltage. It will be noted that the fundamental frequency of this square wave equals the frequency of the sinusoidal voltage.

Figure 3:
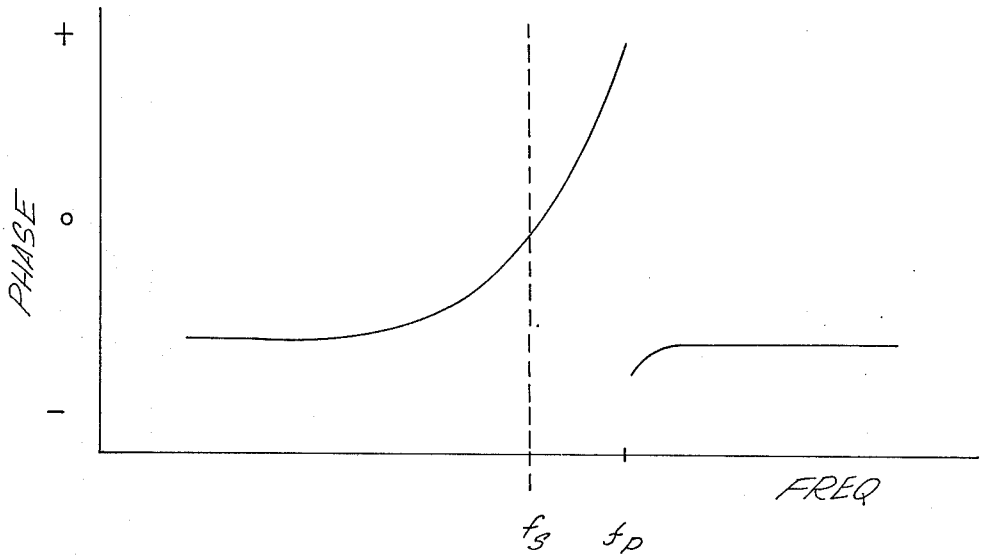
FIG. 3 is a graph showing the frequency-dependent characteristics of the quartz crystal shown in FIG. 2.

With reference again to FIG. 2, a negative feedback amplifier circuit is generally indicated at 35. Circuit 35 responds to the first periodic signal to produce a second periodic signal PS2. A high voltage gain inverting integrated circuit 36 is included in circuit 35. Preferably, circuit 36 is a CD4001 inverter which is sold by various semiconductor manufacturers. In a feedback path of circuit 35 there is provided a quartz crystal 37. A resistor 38 is connected in parallel with quartz crystal 37. A suitable value for resistor 38 is 1.5 megohms. A resistor 39 forms a series element in the feedback path. A suitable value for resistor 39 is 180 kilohms. A trimmer capacitor 40 is connected between the input of circuit 36 and ground. Suitably, trimming capacitor can be adjusted between 5 and 30 picofarads. Resistors 41 and 42 are serially connected between the input of circuit 35 and the input of circuit 36. Suitable values for these resistors are 10 kilohms and 510 kilohms respectively. A capacitor 43 is connected between ground and the junction of resistors 41 and 42. Suitably, capacitor 43 is a 680 picofarad capacitor. A capacitor 44 is connected between the output of circuit 35 and ground. Suitably, capacitor 44 is a 91 picofarad capacitor. As for the characteristics of the quartz crystal, consider now the graph of FIG. 3 which plots the phase angle of the impedance defined by the quartz crystal as a function of frequency. At a predetermined series resonant frequency *fs*, this phase angle is 0, which means that the impedance at that frequency is resistive in nature. For frequencies below *fs*, this phase angle is negative, which means that the impedance is capacitive in nature. For a range of frequencies above *fs* and below a parallel resonant frequency *fp*, this phase angle is positive, which means that the impedance is inductive in nature. Quartz crystal 37 is the same type of crystal as is employed in controlling the watch oscillator. It is specified by the manufacturer as having a natural resonant frequency of 32,768 Hz when loaded with a predetermined capacitor. Thus the design center frequency of 32,768 Hz is in the neighborhood between *fs* and *fp*.

With reference again to FIG. 2, a pair of tandemly connected inverters 45 and 46 are provided. These inverters respond to the output of circuit 35 and provide an input to a NOR gate 47. A variable pulse width signal VPW is produced by NOR gate 47. A smoothing network comprising a resistor 48 and a capacitor 49 is connected between the output of NOR gate 47 and one terminal of indicator 12 which is a conventional ammeter. An offset compensation network comprising resistors 51 and 52 and a potentiometer 53 is provided. The tap of potentiometer 53 is connected to the other terminal of indicator 12.

With reference now to FIG. 4B, there will now be considered circumstances in which the watch oscillator frequency is lower than its design center frequency and is accordingly causing the watch to lose time. In such circumstances, the second periodic signal will be lagging the first periodic signal by a phase difference which exceeds 90°. The VPW signal produced by NOR gate 47 in such circumstances is high (i.e., at or near +V) for somewhat less than one quarter of each cycle, and is low (i.e., at or near ground) for the remaining three quarters of each cycle.

On the other hand, in circumstances in which the watch oscillator frequency is greater than its design center frequency, the second periodic signal lags the first periodic signal by somewhat less than 90°. This is depicted in FIG. 4C. In these circumstances, the VPW signal produced by NOR gate 47 is high for somewhat greater than one quarter of each cycle.

As for the desired situation in which the frequency of the watch oscillator equals its design center frequency, the second periodic signal lags the first periodic signal by 90°. This is depicted in FIG. 4D. In these circumstances, the VPW signal produced by NOR gate 47 is high for one quarter of each cycle.

In summary of the foregoing, the circuitry that produces the PS2 signal provides a phase-shifting circuit means for causing a phase shift to be defined between the PS1 and PS2 signals, with the amount of the phase shift being dependent on the frequency difference between the fundamental frequency and a predetermined standard frequency. And, NOR gate 47 forms part of a phase difference detecting means.

As mentioned above, indicator 12 is a conventional ammeter. The angular position to which its pointer is deflected depends on how much current flows through the ammeter. The amount of the ammeter current depends on the time-averaged value of the VPW signal and on the setting of the offset compensation network. The time-averaged value in turn depends on the width of the variable-width pulses. When their width has a value representative of the desired watch oscillator frequency, zero current flows through the ammeter causing its pointer to indicate zero on the indicator scale.

As for the offset compensation network, suitable values for resistors 51 and 52 are 1 kilohm each. Suitably, potentiometer 53 has 1 kilohm between its end terminals. A suitable value for the current-limiting resistor 48 is 10 kilohm. A suitable meter is a 25 microampere, full scale meter. With the foregoing values, each scale division on indicator 12 corresponds to 1.0 second per month of time that the watch being tested will gain or lose.

In the absence of an input signal at tuned circuit 17, the indictor reading is meaningless. Accordingly, a light emitting diode (LED) 60 is provided for displaying an indication that a signal is being picked up. A buffer circuit 62 drives LED 60 in response to a rectified signal derived from multi-stage amplifier 19.

It will be appreciated from the foregoing description of the preferred embodiment that various modifications thereof fall within the scope of this invention. It will be further appreciated that the principles underlying the phase-shifting circuit means as combined with the phase difference detecting means have application in other types of systems where information is represented by a frequency difference between the fundamental frequency of a periodic signal and a reference frequency.

What is claimed is:

1. Apparatus for testing the timing accuracy of a wristwatch whose timing accuracy depends on the oscillation frequency of an electrical oscillator in the wristwatch, the apparatus comprising:

means for deriving electrical energy radiated from the wristwatch to produce a first periodic signal, the fundamental frequency of which depends on said oscillation frequency;

circuit means responsive to the first periodic signal for producing a second periodic signal, the fundamental frequency of which equals the fundamental frequency of the first periodic signal, the circuit means including frequency-dependent phase-shifting means for causing a phase shift to be defined between the first and second periodic signals with the amount of the phase shift being dependent on the frequency difference between the equal fundamental frequencies and a predetermined standard frequency;

an indicator; and phase difference detecting means responsive to the first and second periodic signals for producing an indicator control signal to cause the indicator to display an indication of said frequency difference.

2. The apparatus of claim 1 wherein said circuit means comprises an amplifier having a negative feedback path, and wherein said phase-shifting means comprises a quartz crystal connected in said negative feedback path.

3. The apparatus of claim 1 wherein the means for producing the first periodic signal includes a shaping cicuit for producing the first periodic signal in the form of a square wave.

4. The apparatus of claim 2 wherein said circuit means includes a digital circuit means for producing the second periodic signal in the form of a square wave, and wherein the phase difference detecting means comprises gating circuit means responsive to the square wave periodic signals for producing time spaced apart pulses that each have a pulse width that depends upon the phase difference between the square wave periodic signals.

5. The apparatus of claim 4 wherein the phase difference detecting means further includes a smoothing circuit for producing a DC voltage whose magnitude is a function of the width of the pulses provided by the gating circuit means.

6. In a system wherein information is defined by a frequency difference between the fundamental frequency of a periodic signal and a reference frequency, the combination comprising:

an amplifier circuit means for receiving said periodic signal as an input signal for producing as its output signal a periodic signal having the same fundamental frequency of the input signal, the amplifier circuit means including a quartz crystal having a natural resonant frequency in the nieghborhood of the reference frequency;

the quartz crystal causing the amplifier circuit means to phase shift its output signal relative to its input signal by an amount that depends upon the difference in frequency between the fundamental frequency and said natural resonant frequency; and phase difference detecting means responsive to said input and output signals for producing a voltage having a magnitude proportional to the amount of the phase shift between the input and output signals.

* * * * *